US006321820B1

(12) United States Patent
Liu

(10) Patent No.: US 6,321,820 B1
(45) Date of Patent: Nov. 27, 2001

(54) SLAT POSITIONING DEVICE FOR A VENETIAN BLIND

(76) Inventor: Tai-Ping Liu, No. 15, Alley 8, Lane 3, Kuo-Chi St., Lung-Ching Hsiang, Taichung Hsien (TW)

( * ) Notice: Subject to any disclaimer, the term of this patent is extended or adjusted under 35 U.S.C. 154(b) by 0 days.

(21) Appl. No.: 09/695,675

(22) Filed: Oct. 24, 2000

(51) Int. Cl.[7] ..... E06B 9/30
(52) U.S. Cl. ..... 160/177 R; 160/178.1 R
(58) Field of Search ..... 160/177 R, 174 R, 160/176.1 R, 178.1 R, 178.3 R

(56) References Cited

U.S. PATENT DOCUMENTS 2,779,403 * 1/1957 Lorentzen .
4,531,563 * 7/1985 Nilsson .
5,267,598 * 12/1993 Marocco .
5,538,068 * 7/1996 Liu .
5,573,052 * 11/1996 Liu .

* cited by examiner

*Primary Examiner*—Blair M. Johnson
(74) *Attorney, Agent, or Firm*—Thorp Reed & Armstrong LLP

(57) ABSTRACT

A Venetian blind slat positioning device has a U-shaped base and a positioning drum. The base has a circular recess formed in each end wall. The positioning drum is rotatably mounted in the base and has a cylinder and two sidewalls respectively extending out radially from the cylinder. The cylinder extends beyond the two ends of each sidewall, and the ends of the cylinder are mounted in the circular recesses in the base end walls. By such an arrangement, the slat positioning device can rotate easily.

4 Claims, 9 Drawing Sheets

SLAT POSITIONING DEVICE FOR A VENETIAN BLIND

BACKGROUND OF THE INVENTION

1. Field of the Invention

The present invention relates to a Venetian blind slat positioning device, and particularly, to a Venetian blind slat positioning device that is easily rotatable.

2. Description of Related Art

With reference to FIGS. 8 and 9, the conventional slat positioning device comprises a base (60) and a positioning drum (40) rotatably mounted in the base (60). The positioning drum (40) comprises two ridges (45), two tapered grooves (42), two recesses (43) and an axial passage (41). The two ridges (45) are integrally formed on the top side of the positioning drum (40). The two tapered grooves (42) each extends from one of the end of the corresponding ridge (45). Each recess (43) is formed at the junction of the ridge (45) and tapered groove (42). The axial passage (41) extends along the central axis of the positioning drum (40). A control rod (61) is inserted into the axial passage (41), and the positioning drum (40) is rotatably mounted in the base (60). Each of two holding rods (51) has a holding protuberance (511) near the end of the rod (51). Each holding rod (51) is capable of being inserted into one of the ridges (45) through the tapered groove (42) to allow the protuberance (511) to be received in the recess (43). One cord is (52) firmly attached to each holding rod (51) and extends through one of the recesses (43) to hold the Venetian blind slats. When operated, the positioning drum (40) can be rotated clockwise or counterclockwise to allow the cord (52) to move up or down, such that the angular position of the Venetian blind slats is controlled.

However, a problem exists in this conventional slat positioning device. The axial passage (41) through the positioning drum (40) is flush with the ends of the positioning drum (40), so that the control rod (61) is actually in contact with the base (60). To ensure that the positioning drum (40) does not slip on the control rod (61), both the positioning drum (40) and the control rod (61) have corresponding facets. Because of the facets on the control rod (61), the control rod (61) does not rotate smoothly on the base (60).

With reference to FIG. 10, another conventional positioning drum (70) is provided. The positioning drum (70) can be used with a Venetian blind using connecting tapes (80) to hold the slats. The positioning drum (70) comprises two tapered recesses (72) and two lateral posts (74). Two tapes (80) used to hold the Venetian blind slats are respectively attached to each post (74) and extend through the corresponding recesses (72). However, the axial passage (71) of this conventional drum (70) is also flush with the ends of the positioning drum (70), such that the rotation of the positioning drum (70) is also restricted by the base (not shown) and influenced by the facets on the control rod (not shown) that passes through the axial passage (71).

In view of the foregoing, a Venetian blind slat positioning device that is easily rotatable is desired.

SUMMARY OF THE INVENTION

The objective of the present invention is to provide a Venetian blind slat positioning device that is easily rotatable.

To achieve the objective, the Venetian blind slat positioning device in accordance with the present invention comprises a U-shaped base and a positioning drum. The U-shaped base has a circular recess formed in each end. The positioning drum is rotatably mounted on the base and has a cylinder that extends through and beyond the ends of the positioning drum to correspond to the circular recesses in the base.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
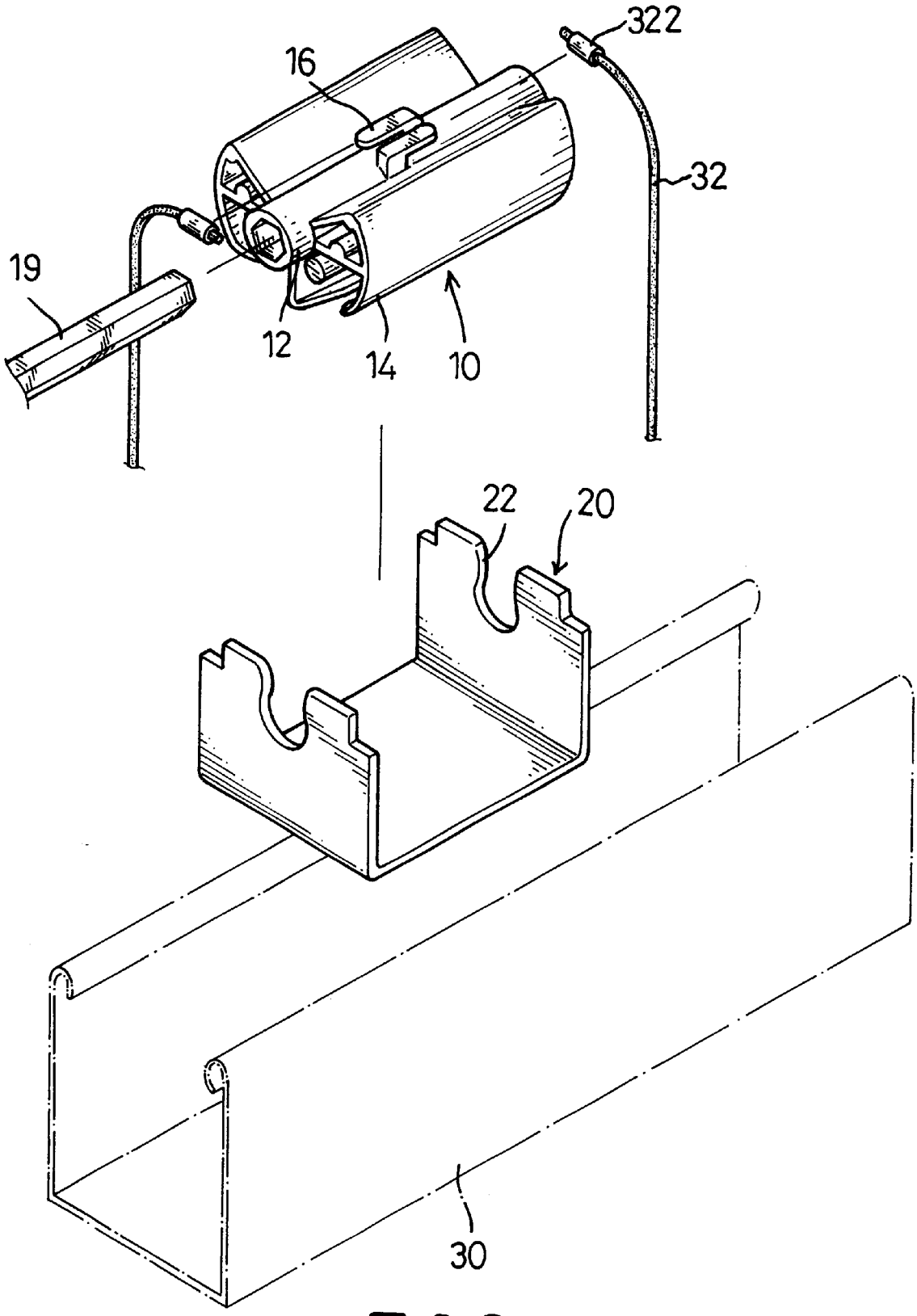
FIG. 1 is an exploded perspective view of the Venetian blind slat positioning device in accordance with the present invention.
Figure 2:
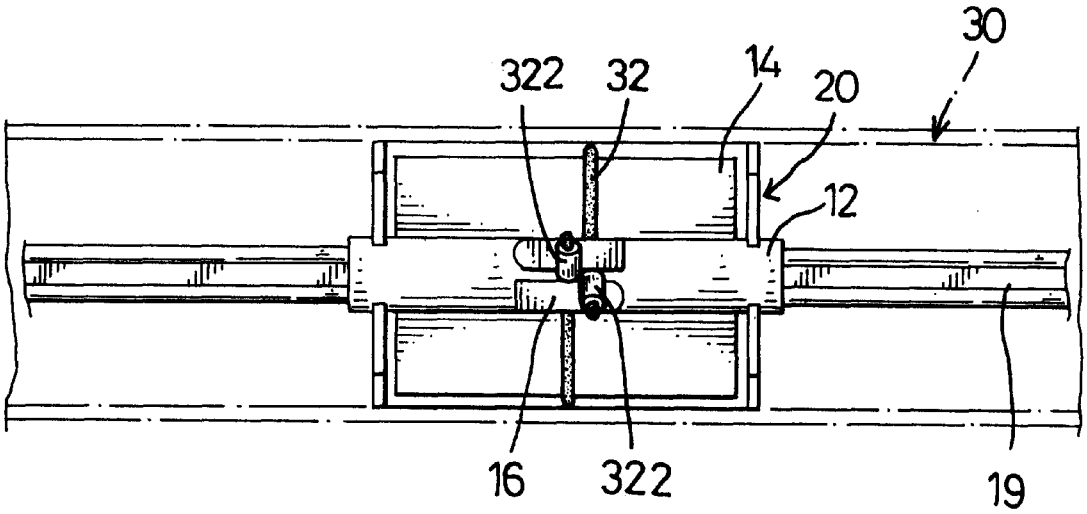
FIG. 2 is a top plan view of the Venetian blind slat positioning device in FIG. 1.
Figure 3:
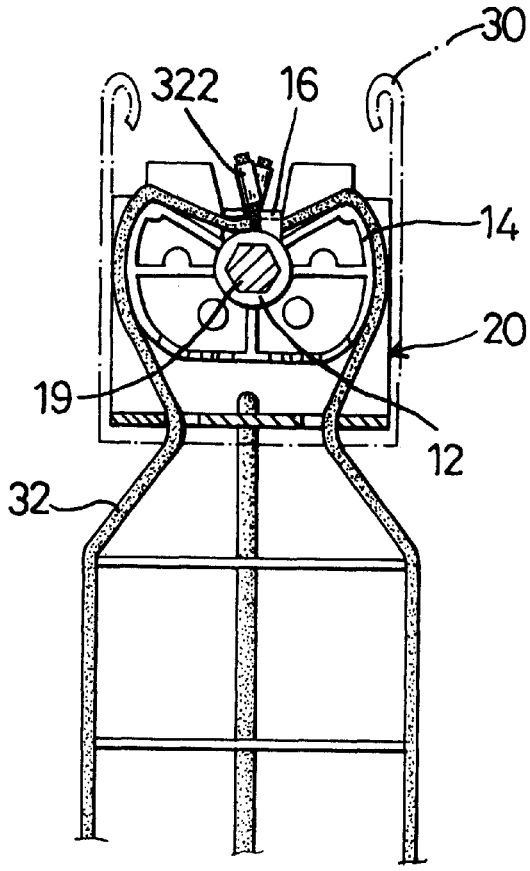
FIG. 3 is an side plan view of the Venetian blind slat positioning device in FIG. 1.

With reference to FIGS. 1, 2 and 3, the Venetian blind slat positioning device in accordance with the present invention comprises a base (20) and a positioning drum (10).

The base (20) is U-shaped with two end walls extending upwards. A circular recess (22) is defined at the top of each of the two end walls of the base (20).

The positioning drum (10) comprises a hollow cylinder (12), two radially arcuate sidewalls (14) and two locking hooks (16).

The hollow cylinder (12) has a round outer periphery and a multiple faceted inner periphery. Each end of the hollow cylinder (12) corresponds to a circular recess (22) in the base (20).

The two sidewalls (14) respectively extend out radially from one side of the hollow cylinder (12) and then curve downward to match the curvature of the cylinder (12). Each sidewall (14) has a first edge connecting with the cylinder (12) and a second edge opposite to the first edge separate from the cylinder (12). The ends of the hollow cylinder (12) extend beyond the ends of the sidewalls (14).

The two locking hooks (16) respectively extend from the outside surface of the hollow cylinder (12) at the junction between the hollow cylinder (12) and the first edges of the sidewalls (14).

Two cords (32) hold the Venetian blind slats. An enlarged tag (322) is firmly attached to the end of each cord (32), and the enlarged tag (322) and cord (32) are held by the locking hook (16).

A control rod (19) with a multiple faceted outer periphery is inserted through and engages with facets on the inner periphery of the cylinder (12) to control the rotation of the cylinder (12) and the positioning drum (10).

After inserting the control rod (19) through the cylinder (12), the exposed ends of the cylinder (12) can be rotatably received in the two circular recesses (22) of the base (20). Then the base (20) is fixedly mounted in a Venetian blind headrail (30).

Figure 4:
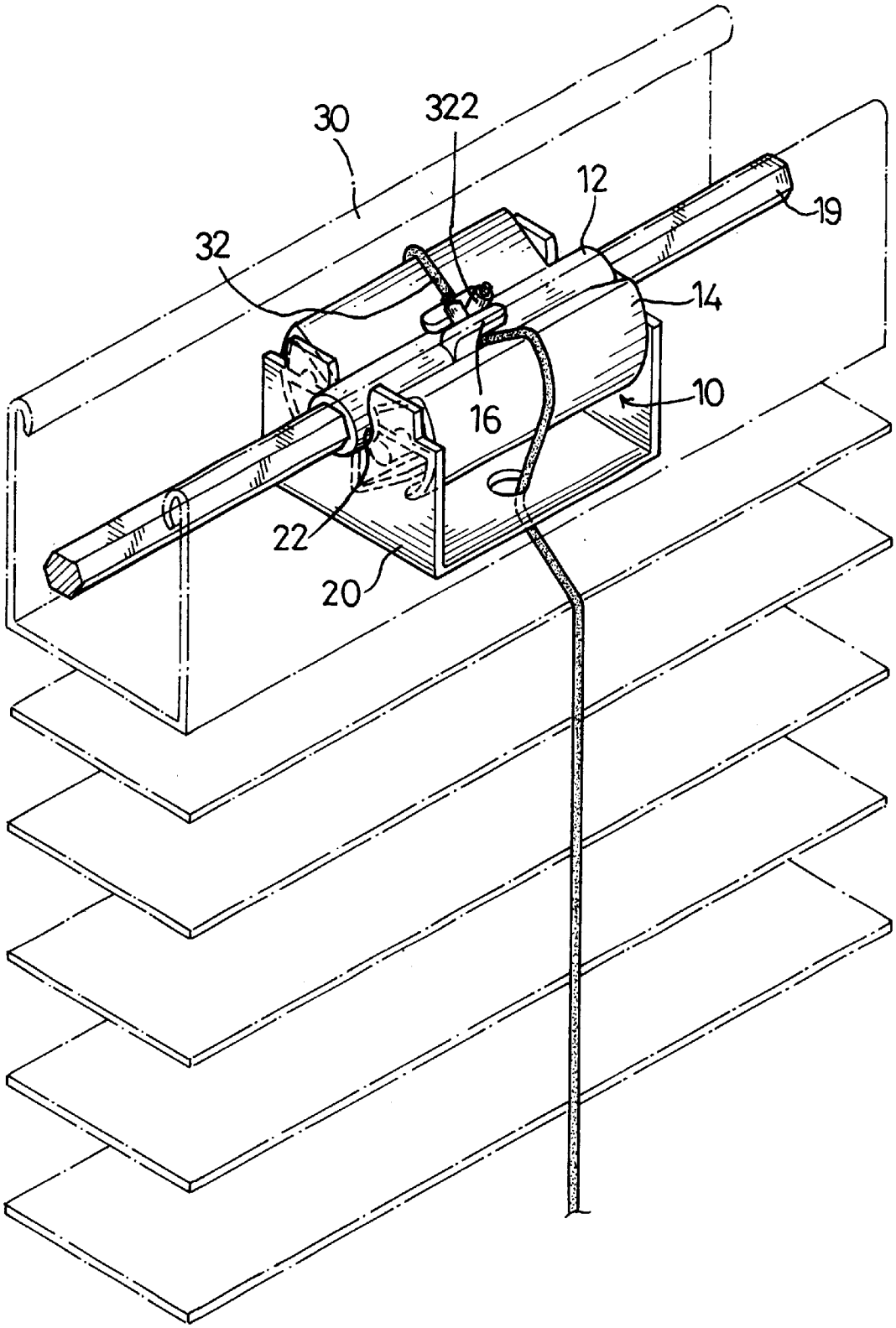
FIG. 4 is an operational perspective view of the Venetian blind slat positioning device in FIG. 1.

With reference to FIG. 4, the base (20) together with the positioning drum (10) is mounted in the Venetian blind headrail (30). The positioning drum (10) is rotatably mounted in the base (20) with the ends of the cylinder (12) rotatably received in the circular recesses (22). The enlarged tag (322) is firmly attached to the cord (32), which abut the locking hook (16) to attach the cord (32) to the positioning drum (10). Thus, when the control rod (19) rotates, the positioning drum (10) will rotate and move the cords (32) up or down to control the angular position of the slats.

Figure 5:
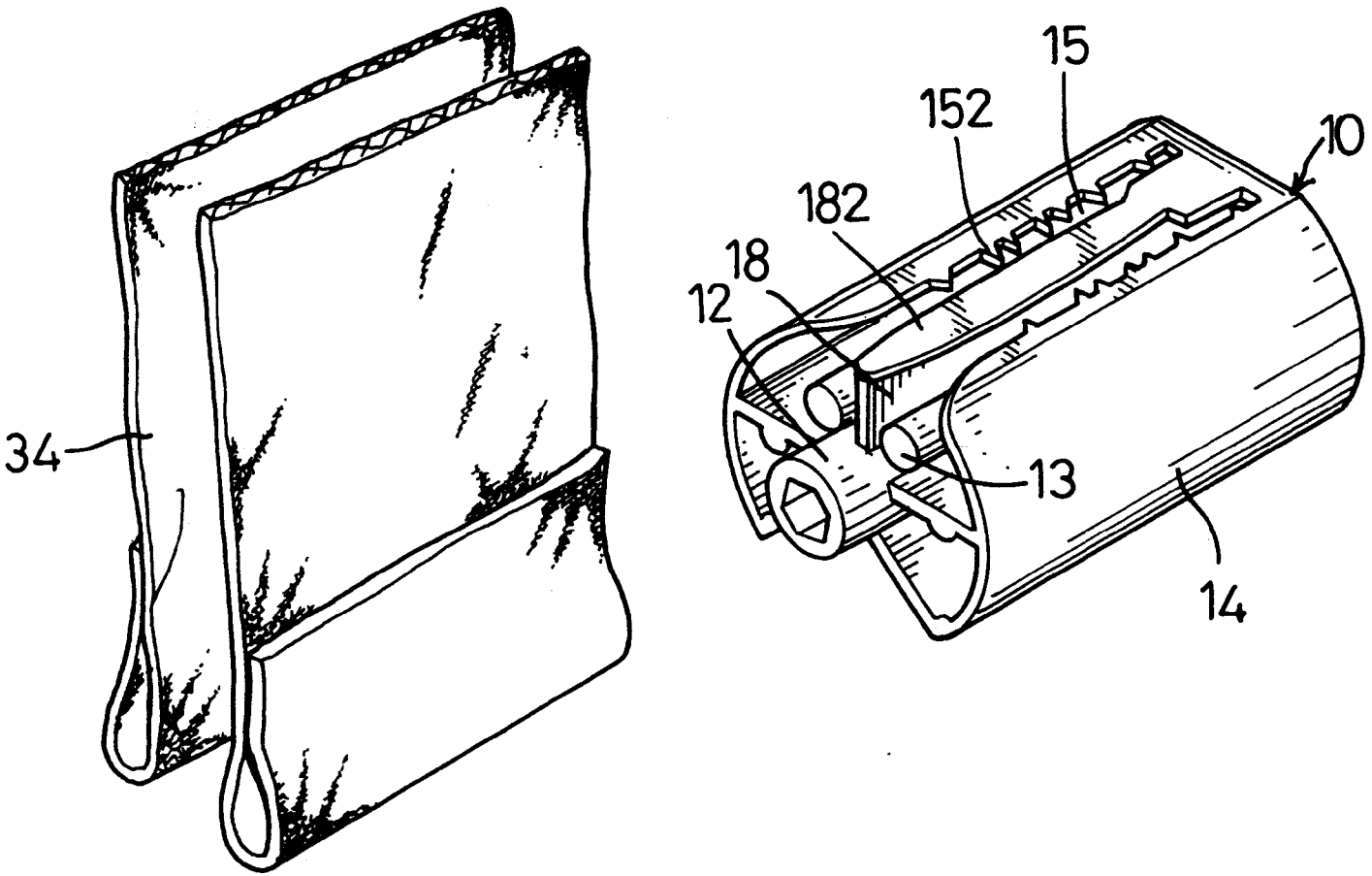
FIG. 5 is a perspective view of another embodiment of the Venetian blind slat positioning device positioning drum in accordance with the present invention.
Figure 6:
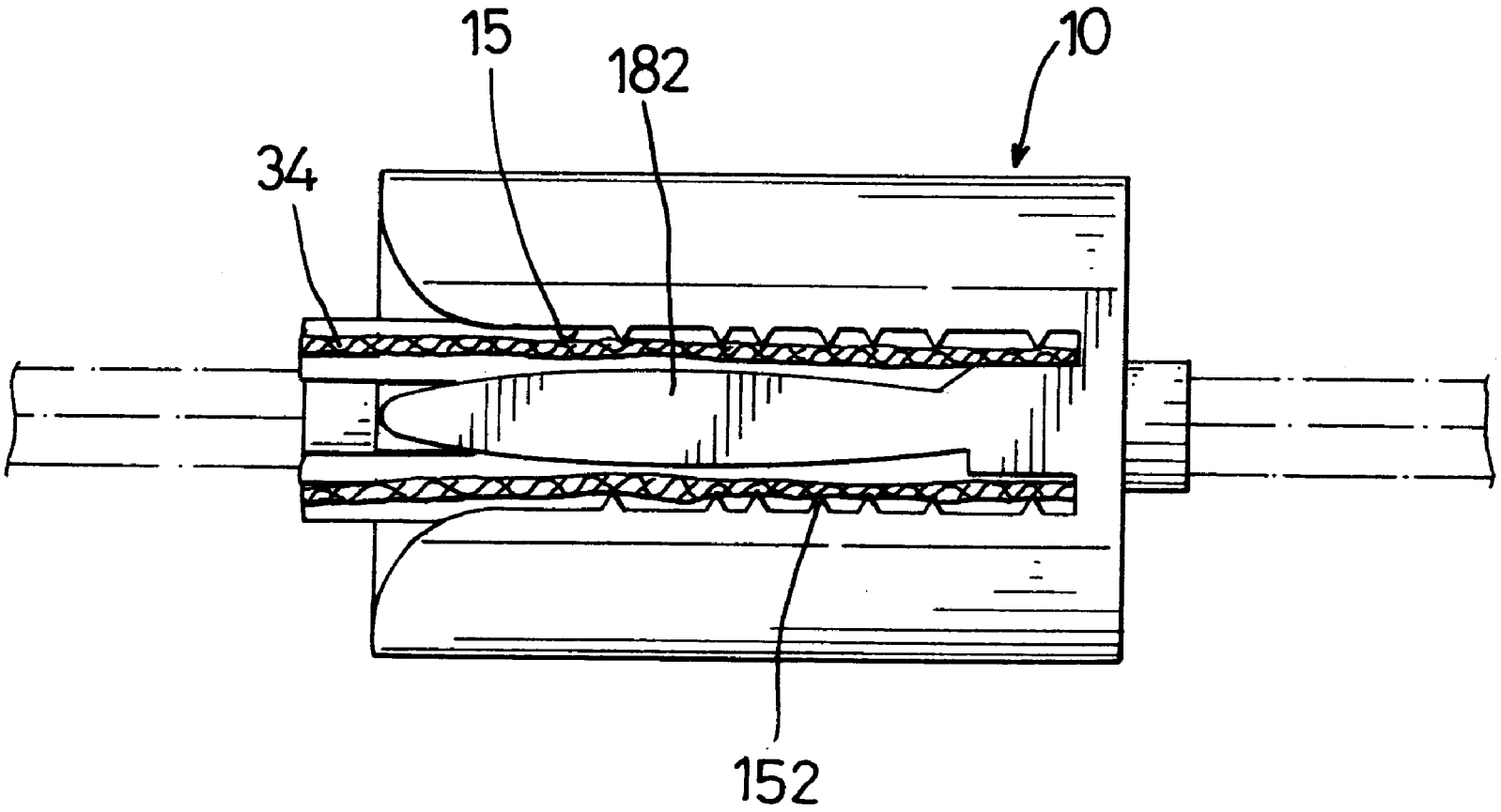
FIG. 6 is an operational top plan view of the Venetian blind slat positioning device positioning drum in FIG. 5 with two connecting tapes in the corresponding tapered grooves.
Figure 7:
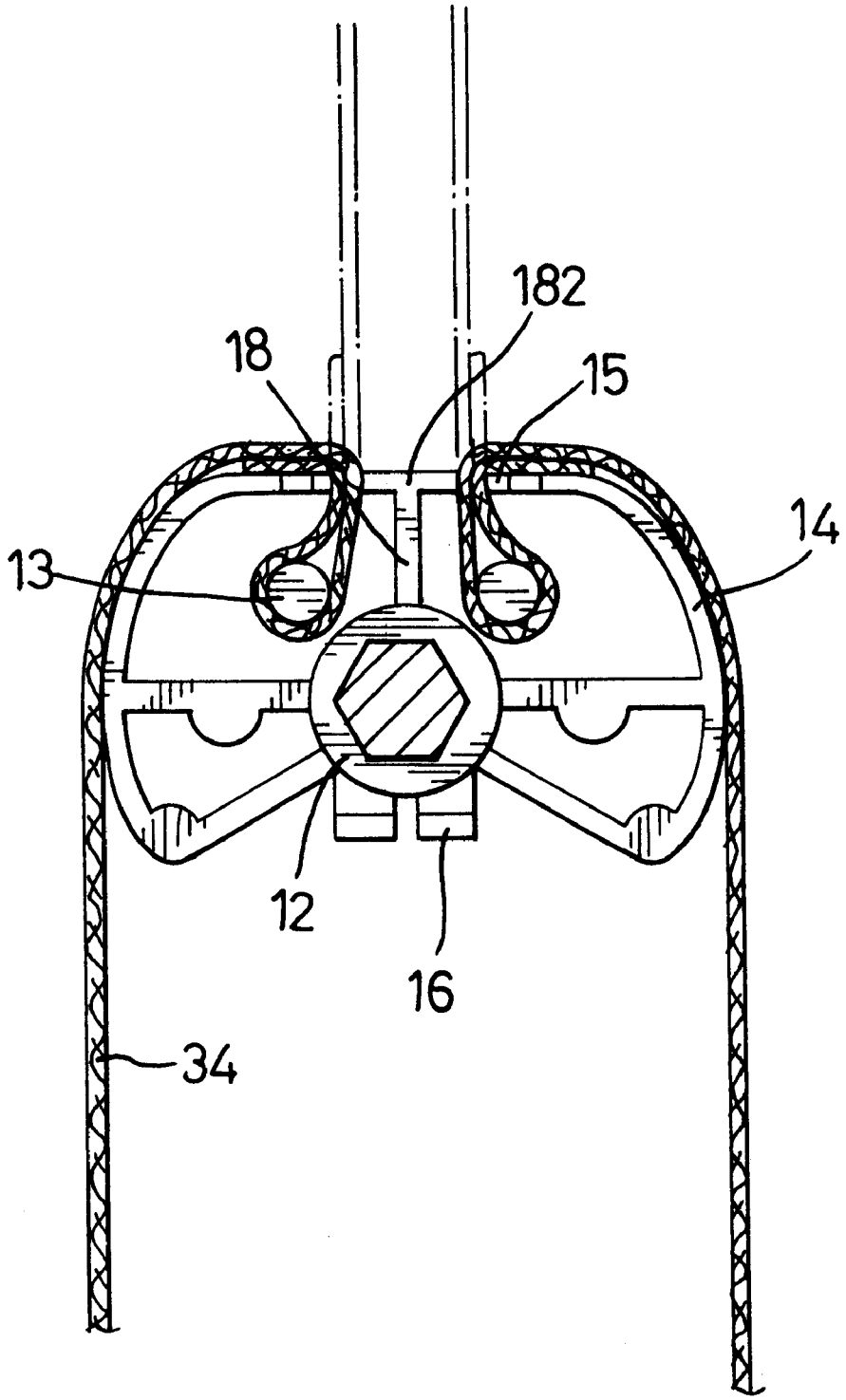
FIG. 7 is a side plan view of the Venetian blind slat positioning positioning drum in FIG. 5 with the Venetian blind connecting tapes.
Figure 8:
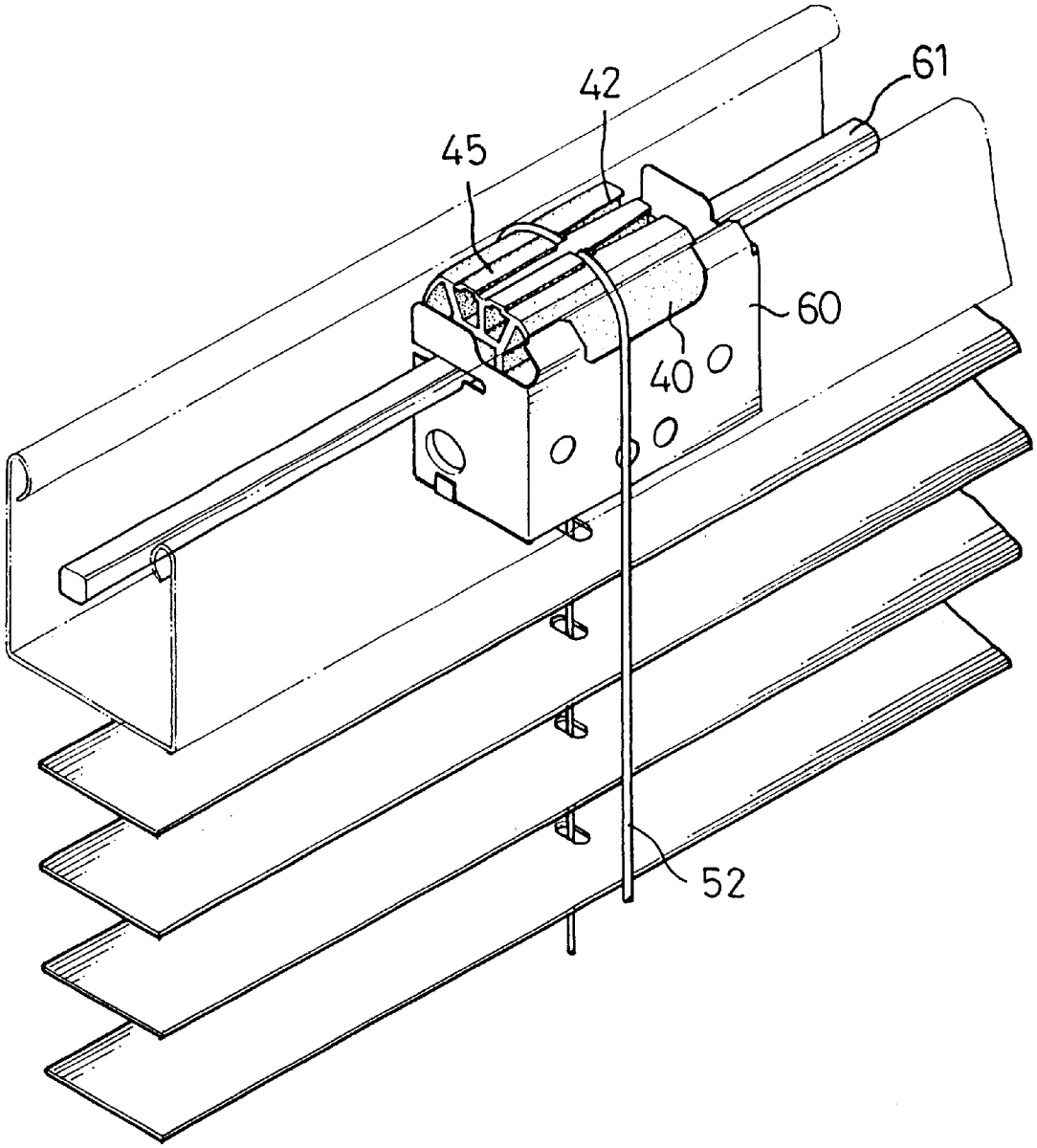
FIG. 8 PRIOR ART
FIG. 8 is an exploded perspective view of a conventional Venetian blind slat positioning device.
Figure 9:
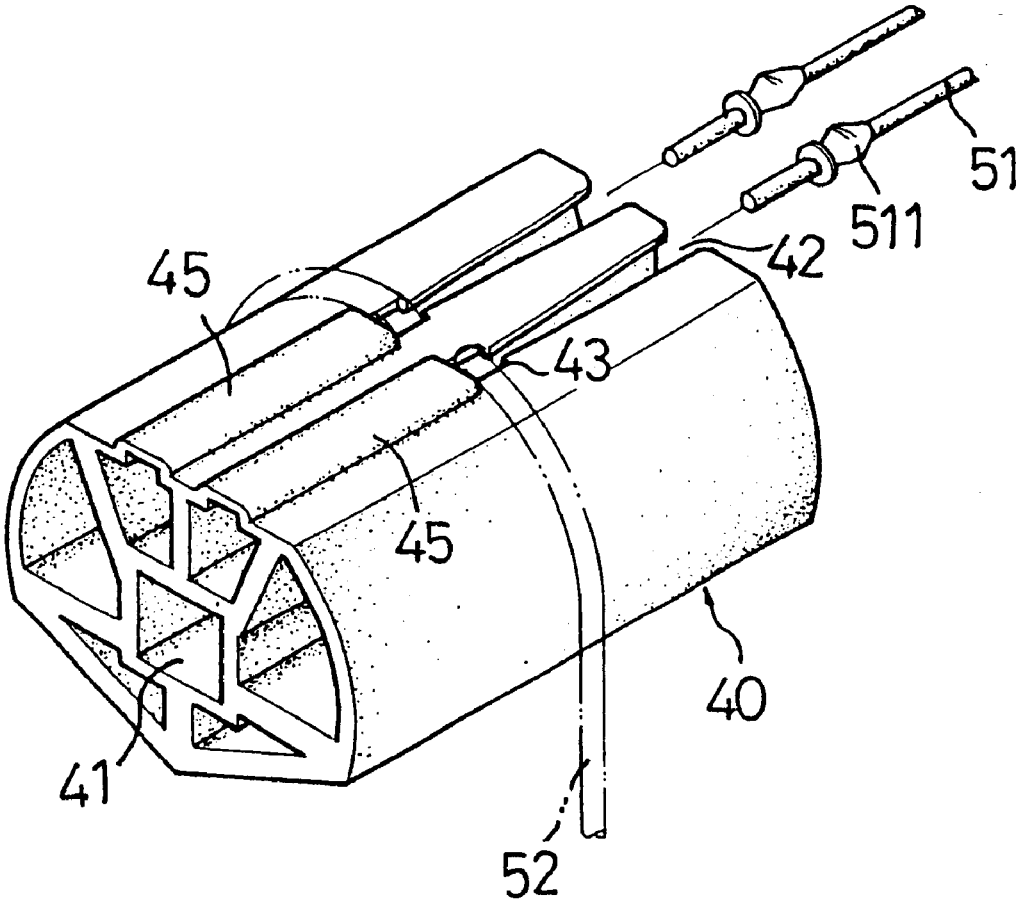
FIG. 9 PRIOR ART
FIG. 9 is an exploded perspective view of the conventional Venetian blind slat positioning device positioning drum and cords in FIG. 8.
Figure 10:
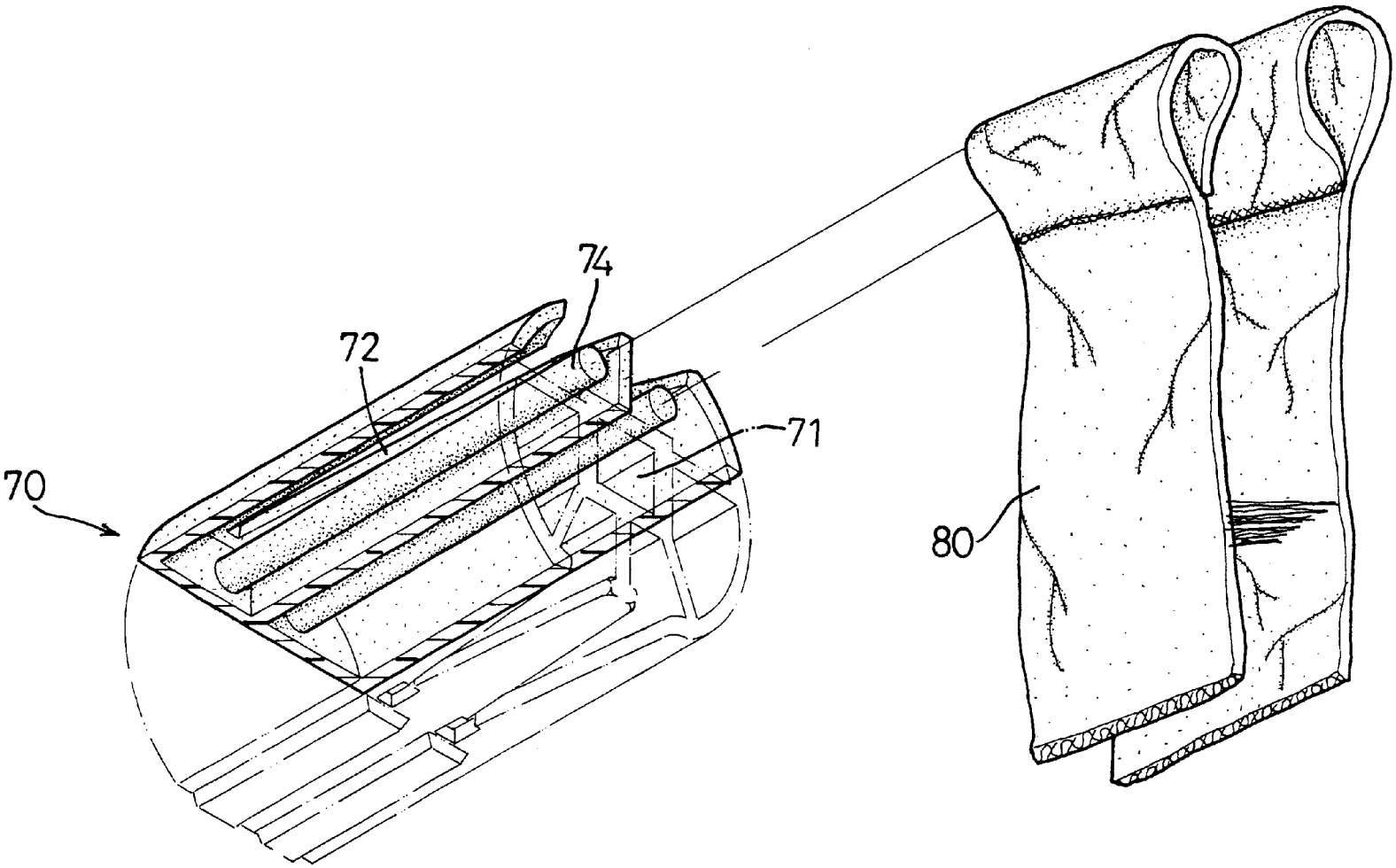
FIG. 10 PRIOR ART
FIG. 10 is an exploded perspective view of another conventional Venetian blind slat positioning drum.

With reference to FIGS. 5 to 7, a protrusion (18) radially extends from the cylinder (12) on the side opposite to the locking hooks (16). A head (182) laterally extends from the free end of the protrusion (18). A slot clamp (15) is defined between the second edge of each sidewall (14) and the corresponding edge of the head (182). The head (182) is connected with the free end of each sidewall (14) at one end of the head (182), such that one end of each slot clamp (15) is closed. Multiple teeth (152) are formed on the second edge of each sidewall (14). A post (13) is laterally positioned between the cylinder (12) and the second edge of each sidewall (14). Each post (13) aligns with the corresponding slot clamp (15).

By such an arrangement, the connecting tapes (34) connected to the Venetian blind slats are attached to the corresponding posts (13) and extend through the corresponding slot clamps (15). The teeth (152) on the second edge of each sidewall (14) enhance the engagement between each tape (34) and the corresponding slot clamp (15). The positioning drum (10) can also be used with a Venetian blind using connecting tape (34) to hold the slats. The use of the positioning drum (10) is more versatile.

Although the present invention has been explained in relation to its preferred embodiment, it is to be understood that many other possible modifications and variations can be made without departing from the spirit and scope of the invention as claimed.

What is claimed is:

1. A Venetian blind slat positioning device comprising:

a U-shaped base with one circular recess formed on each end wall; and a positioning drum having a cylinder with a round outer periphery, a multiple faceted inner periphery, two sidewalls respectively extending radially from the cylinder and then curving downwards, each sidewall having a first edge connected to the cylinder and a second edge separated from the cylinder, two locking hooks respectively extending from a surface of the cylinder at the junction between the cylinder and the sidewalls, two ends of the cylinder respectively and rotatably received in the circular recess in the base, with the cylinder extending beyond the two ends of each sidewall.

2. The slat positioning device as claimed in claim 1, wherein a protrusion radially extends from the cylinder on the side opposite to the locking hooks;

a head extends laterally from a free end of the protrusion;

a slot clamp is defined between the second edge of each sidewall and each edge of the head; and a post is laterally positioned between the cylinder and the second edge of each sidewall and aligns with each slot clamp.

3. The slat positioning device as claimed in claim 2, wherein multiple teeth are formed on the second edge of each sidewall.

4. The slat positioning device as claimed in claim 3, wherein the head is connected to the free edge of each sidewall at one end of the head, such that one end of each slot clamp is closed.

* * * * *